US010828745B2

(12) United States Patent
Wu et al.

(10) Patent No.: US 10,828,745 B2
(45) Date of Patent: Nov. 10, 2020

(54) POLISHING PAD AND POLISHING METHOD

(71) Applicant: IV Technologies CO., Ltd., Taichung (TW)

(72) Inventors: Chung-Ru Wu, Kaohsiung (TW); Yu-Hao Pan, Taichung (TW); Kun-Che Pai, Taichung (TW); Chun-Ming Ting, Yunlin County (TW)

(73) Assignee: IV Technologies CO., Ltd., Taichung (TW)

( * ) Notice: Subject to any disclaimer, the term of this patent is extended or adjusted under 35 U.S.C. 154(b) by 278 days.

(21) Appl. No.: 15/869,041

(22) Filed: Jan. 12, 2018

(65) Prior Publication Data

US 2018/0200864 A1 Jul. 19, 2018

(30) Foreign Application Priority Data

Jan. 19, 2017 (TW) ..... 106101812 A

(51) Int. Cl.

| | |
|---|---|
| ***B24B 37/22*** | (2012.01) |
| ***B24B 37/24*** | (2012.01) |
| ***B24D 11/02*** | (2006.01) |
| ***B24B 37/04*** | (2012.01) |

(52) U.S. Cl.

CPC ..... *B24B 37/22* (2013.01); *B24B 37/042* (2013.01); *B24B 37/24* (2013.01); *B24D 11/02* (2013.01)

(58) Field of Classification Search

CPC ..... B24B 37/042; B24B 37/22; B24B 37/24; B24D 11/00; B24D 11/02

USPC ..... 451/41, 526, 528, 533

See application file for complete search history.

(56) References Cited

U.S. PATENT DOCUMENTS

| | | | | |
|---|---|---|---|---|
| 5,212,910 | A * | 5/1993 | Breivogel | B24B 37/26 451/530 |
| 6,290,589 | B1 * | 9/2001 | Tolles | B24B 37/22 451/526 |
| 6,699,104 | B1 * | 3/2004 | Baker, III | B24B 37/22 451/28 |
| 7,131,901 | B2 | 11/2006 | Shih et al. | |
| 7,549,914 | B2 * | 6/2009 | Ladjias | B24B 37/22 451/533 |

(Continued)

FOREIGN PATENT DOCUMENTS

| | | |
|---|---|---|
| CN | 1400636 | 3/2003 |
| CN | 201239920 | 5/2009 |

(Continued)

OTHER PUBLICATIONS

"Office Action of China Counterpart Application," dated May 15, 2019, p. 1-p. 12.

*Primary Examiner* — Eileen P Morgan
(74) *Attorney, Agent, or Firm* — JCIPRNET

(57) ABSTRACT

A polishing pad is provided. The polishing pad, disposed on a polishing platen and suitable for a polishing process, includes a polishing layer, an adhesive layer and at least one adhesion-reducing interface layer. The adhesive layer is disposed between the polishing layer and the polishing platen. The at least one adhesion-reducing interface layer is disposed between the adhesive layer and the polishing layer and/or disposed between the adhesive layer and the polishing platen. An area of the at least one adhesion-reducing interface layer is smaller than an area of the adhesive layer.

21 Claims, 4 Drawing Sheets

(56) References Cited

U.S. PATENT DOCUMENTS

| | | | | |
|---|---|---|---|---|
| 10,189,143 | B2 * | 1/2019 | Huang | B24B 37/20 |
| 10,201,887 | B2 * | 2/2019 | Chen | B24B 37/30 |
| 2003/0171070 | A1 | 9/2003 | Tolles | |
| 2007/0039925 | A1 * | 2/2007 | Swedek | B24B 37/013 216/84 |
| 2007/0072526 | A1 * | 3/2007 | Ladjias | B24B 37/22 451/533 |
| 2008/0099443 | A1 * | 5/2008 | Benvegnu | B24B 37/013 216/84 |
| 2013/0012107 | A1 * | 1/2013 | Kazuno | B24B 37/22 451/41 |
| 2014/0065932 | A1 * | 3/2014 | Kazuno | C09J 167/00 451/59 |
| 2015/0004879 | A1 * | 1/2015 | Nakai | B24B 37/24 451/41 |
| 2015/0065013 | A1 * | 3/2015 | Jensen | B24B 37/205 451/41 |
| 2015/0174826 | A1 * | 6/2015 | Murugesh | B24B 37/205 264/425 |
| 2016/0144477 | A1 * | 5/2016 | Scott | B24B 37/22 451/538 |
| 2017/0073456 | A1 * | 3/2017 | Shimizu | C08G 18/4833 |
| 2017/0173758 | A1 * | 6/2017 | Lehuu | B24B 37/22 |
| 2018/0281148 | A1 * | 10/2018 | Lehuu | B24B 37/22 |

FOREIGN PATENT DOCUMENTS

| | | |
|---|---|---|
| CN | 102029571 | 4/2011 |
| CN | 102248494 | 11/2011 |
| JP | 2001315056 | 11/2001 |
| JP | 2008053376 | 3/2008 |
| TW | 200512061 | 4/2005 |
| TW | I313209 | 8/2009 |

* cited by examiner

POLISHING PAD AND POLISHING METHOD

CROSS-REFERENCE TO RELATED APPLICATION

This application claims the priority benefit of Taiwan application serial no. 106101812, filed on Jan. 19, 2017. The entirety of the above-mentioned patent application is hereby incorporated by reference herein and made a part of this specification.

BACKGROUND OF THE INVENTION

1. Field of the Invention

The invention relates to a polishing pad and a polishing method, and particularly relates to a polishing pad which is capable of alleviating a concentrated stress generated during a polishing process and a polishing method using the polishing pad.

2. Description of Related Art

During a device manufacturing process in the industry, a polishing process is commonly adopted nowadays to planarize a surface of an object being polished. During the polishing process, a slurry may be optionally provided between the surface of the object and a polishing pad, and the surface may be planarized through mechanical friction generated by relative movement between the object and the polishing pad. However, as an adhesive layer is normally provided at interfaces between respective layers of the polishing pad or at an interface between the polishing pad and a polishing platen for tight adhesion, a concentrated stress generated during the polishing process may easily cause protrusion or deformation in the polishing pad. Consequently, the protrusion may hit the object and damage the polishing pad, or the object being polished may be broken.

Currently, U.S. Pat. No. 7,131,901 and Japan Patent Publication No. 2008-53376 have disclosed solutions which are capable of alleviating the concentrated stress generated during a polishing process. However, in these solutions, a recess is provided on a back surface of a polishing layer or on an adhesive layer, so the interfaces include a discontinuous surface. Consequently, bubbles may be easily generated at different interfaces during adhesion in a process of manufacturing the polishing pad. Thus, the stability of the polishing pad is affected.

Hence, additional work is still required to deal with the concentrated stress generated during the polishing process, so that the industry can have more choices.

SUMMARY OF THE INVENTION

The invention provides a polishing pad and a polishing method, where the polishing pad is able to alleviate a concentrated stress exerted on the polished pad during a polishing process.

An embodiment of the invention provides a polishing pad. The polishing pad is disposed on a polishing platen and suitable for a polishing process. In addition, the polishing pad includes a polishing layer, an adhesive layer and at least one adhesion-reducing interface layer. The adhesive layer is disposed between the polishing layer and the polishing platen. The at least one adhesion-reducing interface layer is disposed between the adhesive layer and the polishing layer and/or disposed between the adhesive layer and the polishing platen. An area of the at least one adhesion-reducing interface layer is smaller than an area of the adhesive layer.

An embodiment of the invention provides a polishing pad. The polishing pad is disposed on a polishing platen and suitable for a polishing process. In addition, the polishing pad includes a polishing layer, a base layer, a first adhesive layer, a second adhesive layer, and at least one adhesion-reducing interface layer. The base layer is disposed below the polishing layer. The first adhesive layer is disposed between the polishing layer and the base layer. The second adhesive layer, disposed between the base layer and the polishing platen. An area of the at least one adhesion-reducing interface layer is smaller than an area of the first adhesive layer or an area of the second adhesive layer, and the at least one adhesion-reducing interface layer is disposed at least one of the following positions: (a) between the first adhesive layer and the polishing layer; (b) between the first adhesive layer and the base layer; (c) between the base layer and the second adhesive layer; and (d) between the second adhesive layer and the polishing platen.

A polishing method according to an embodiment of the invention is suitable for polishing an object and includes the following: providing the polishing pad according to any one of the above polishing pads; exerting a stress on the object to press the object against the polishing pad; and moving the object and the polishing pad relatively to perform the polishing process.

Based on the above, the polishing pad according to the embodiments of the invention includes the at least one adhesion-reducing interface layer disposed between the adhesive layer and the polishing layer and/or disposed between the adhesive layer and the polishing platen and has a feature that the area of at least one adhesion-reducing layer is smaller than the area of the adhesive layer, or includes the at least one adhesion-reducing interface layer disposed between the first adhesive layer and the polishing layer, between the first adhesive layer and the base layer, between the base layer and the second adhesive layer, or between the second adhesive layer and the polishing platen and has a feature that the area of at least one adhesion-reducing layer is smaller than an area of the first adhesive layer or an area of the second adhesive layer. Therefore, during a polishing process, the polishing pad according to the embodiments of the invention is capable of alleviating the concentrated stress exerted on the polishing pad.

In order to make the aforementioned and other features and advantages of the invention comprehensible, several exemplary embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
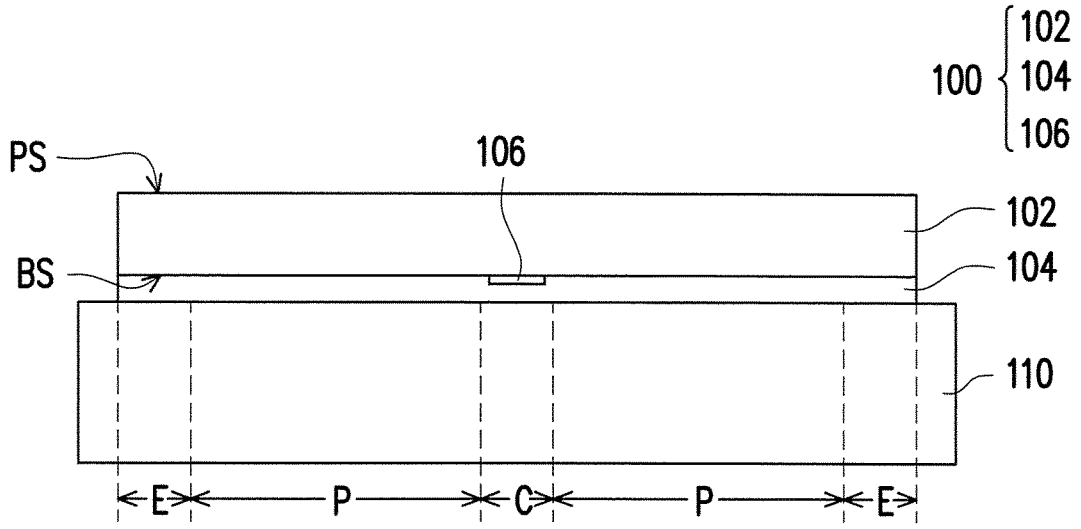
FIG. 1 is a schematic cross-sectional view illustrating a polishing pad disposed on a polishing platen according to an embodiment of the invention.

Reference will now be made in detail to the present preferred embodiments of the invention, examples of which are illustrated in the accompanying drawings. Wherever possible, the same reference numbers are used in the drawings and the description to refer to the same or like parts.

FIG. 1 is a schematic cross-sectional view illustrating a polishing pad according to an embodiment of the invention being arranged in a polishing system. Specifically, FIG. 1 is a schematic cross-sectional view taken along a radius direction of a polishing pad 100.

Referring to FIG. 1, the polishing pad 100 is disposed on a polishing platen 110. In general, the polishing platen 110 is a circular rotary platen and has a rotating direction. When the polishing platen 110 rotates, the polishing pad 100 on the polishing platen 110 is driven to rotate simultaneously, so as to carry out a polishing process. In other words, the polishing pad 100 is suitable for a polishing process.

In the embodiment, the polishing pad 100 includes a central region C, a peripheral region E, and a main polishing region P which is located between the central region C and the peripheral region E. Specifically, in the embodiment, the polishing pad 100 is circular, the central region C is a circular region concentric with the polishing pad 100, the main polishing region P surrounds the central region C, and the peripheral region E surrounds the main polishing region P. Besides, in the embodiment, the polishing pad 100 includes a polishing layer 102, an adhesive layer 104, and an adhesion-reducing interface layer 106.

The polishing layer 102 has a polishing surface PS and a back surface BS opposite to the polishing surface PS. In addition, the bottom surface BS is a flat surface. In other words, in the embodiment, no recess or groove pattern is provided on the back surface BS of the polishing layer 102. Besides, in the embodiment, the polishing layer 102 includes a polymer base material, such as polyester, polyether, polyurethane, polycarbonate, polyacrylate, polybutadiene, or other polymer base materials synthesized from a suitable thermosetting resin or a thermoplastic resin. However, the invention is not limited thereto.

The adhesive layer 104 is disposed between the polishing layer 102 and the polishing platen 110. Specifically, in the embodiment, the back surface BS of the polishing layer 102 and the polishing platen 110 are adhered through the adhesive layer 104. In other words, the polishing pad 100 is adhered and fixed to the polishing platen 110 through the adhesive layer 104. Besides, in the embodiment, the adhesive layer 104 is a continuous glue layer including (but not limited to) an unsupported glue layer or a double-sided glue layer. The material of the glue layer includes, for example, an acrylic-based glue, an epoxy resin-based glue, or a polyurethane-based glue. However, the invention is not limited thereto.

The adhesion-reducing interface layer 106 is disposed between the adhesive layer 104 and the polishing layer 102. Specifically, a region where the adhesion-reducing interface layer 106 is disposed is a stress concentrated region during the polishing process, for example. In the embodiment, the adhesion-reducing interface layer 106 is disposed in the central region C of the polishing pad 100. In an embodiment, a manufacturing process of the polishing pad 100 includes: forming the adhesion-reducing interface layer 106 on the back surface BS of the polishing layer 102 and then entirely forming the adhesive layer 104, or forming the adhesion-reducing interface layer 106 on the adhesive layer 104 and then forming the adhesive layer 104 and the adhesion-reducing interface layer 106 together on the back surface BS of the polishing layer 102. In addition, the adhesive layer 104 may be formed by bonding or coating, for example. Accordingly, in the embodiment, the adhesion-reducing interface layer 106 contacts the back surface BS of the polishing layer 102 and is covered by the adhesive layer 104.

Besides, in the embodiment, the area of the adhesion-reducing interface layer 106 is smaller than the area of the adhesive layer 104. Specifically, the area of the adhesion-reducing interface layer 106 is in a range from 0.01% to 20% of the area of the adhesive layer 104, and preferably in a range from 0.05% to 10% of the area of the adhesive layer 104. When the area of the adhesion-reducing interface layer 106 is smaller than 0.01% of the area of the adhesive layer 104, the polishing pad may be difficult to alleviate the stress. When the area of the adhesion-reducing interface layer 106 is greater than 20% of the area of the adhesive layer 104, the polishing pad may be detached from the polishing platen during the polishing process due to an excessively small effective adhesive area.

Besides, in the embodiment, the adhesion-reducing interface layer 106 includes (but is not limited to): (1) an anti-adhesive agent or a release agent implemented by coating, wherein the anti-adhesive agent is an organic oil or an organic solvent, for example, and the release agent is a fluorine-containing release agent or a silicone-containing release agent, for example; (2) a powder, a fiber, an isolation film, or a low adhesion glue implemented by attachment or adhesion, wherein the powder is a metal powder, a ceramic powder, or an organic powder, for example, the fiber may be a natural fiber or an artificial fiber, for example, the isolation film may be a continuous or a discontinuous film and may be a metal film, a polymer thin film, or a release film, for example, and the low adhesion glue may be a silicone-based glue or a rubber-based glue; or (3) a surface treatment layer implemented by a surface treatment process, wherein the surface treatment layer may be a surface treatment layer with a significantly reduced adhesion formed on the surface of the adhesive layer 104 through a physical process or a chemical process, for example, and the process may be a high temperature process, an irradiation process, an implantation process, a gas process, a plasma process, or a chemical solution process. In other words, in the embodiment, an adhesion between the adhesion-reducing interface layer 106 and the polishing layer 102 is less than an adhesion between the adhesive layer 104 and the polishing layer 102, and/or an adhesion between the adhesive layer 104 and the adhesion-reducing interface layer 106 is less than the adhesion between the adhesive layer 104 and the polishing layer 102. For example, when the adhesion-reducing interface layer 106 includes a powder, a fiber, an isolation film, a low adhesion glue or a surface treatment layer, the adhesion between the adhesion-reducing interface layer 106 and the polishing layer 102 is less than the adhesion between the adhesive layer 104 and the polishing layer 102. In another example, when the adhesion-reducing interface layer 106 includes an anti-adhesion agent or a release agent, the adhesion between the adhesion-reducing interface layer 106 and the polishing layer 102 is less than the adhesion between the adhesive layer 104 and the polishing layer 102, and the adhesion between the adhesive layer 104 and the adhesion-reducing interface layer 106 is less than the adhesion between the adhesive layer 104 and the polishing layer 102. Therefore, an adhesion between a portion of the adhesive layer 104 covering the adhesion-reducing interface layer 106 and the polishing layer 102 may be significantly reduced because of the adhesion-reducing interface layer 106. Specifically, compared with an adhesion between the adhesive layer 104 and the polishing layer 102 in a region without the adhesion-reducing interface layer 106, the adhesion between the adhesive layer 104 and the polishing layer 102 in the region with the adhesion-reducing interface layer 106 is reduced by 50% to 100%, and is preferably reduced by 80% to 100%.

It should be noted that, in the embodiment, since the polishing pad 100 includes the adhesion-reducing interface layer 106 disposed between the adhesive layer 104 and the polishing layer 102, and the area of the adhesion-reducing interface layer 106 is smaller than the area of the adhesive layer 104, the polishing pad 100 is able to alleviate the concentrated stress exerted on the polishing pad 100 when a polishing process is performed with the polishing pad 100. The reasons are described in detail in the following. Since the adhesion-reducing interface layer 106 is disposed between the adhesive layer 104 and the polishing layer 102, the adhesion in a stress concentrated region which is located between the adhesive layer 104 and the polishing layer 102 is significantly reduced. Therefore, during the polishing process, the region where the adhesion-reducing interface layer 106 is located in the polishing layer 102 may be deformed or shift to a suitable extent to alleviate the concentrated stress exerted on the polishing pad 100. Hence, the stress concentrated region of the polishing pad 100 may be prevented from being significantly protruding, deformed, or damaged due to the stress exerted. As a result, the usage life of the polishing pad 100 is prolonged. In another perspective, since the adhesion-reducing interface layer 106 is disposed in the central region C of the polishing pad 100, the polishing pad 100 is suitable for a polishing process whose stress concentrated region is located in the central region C. In other words, the region where the adhesion-reducing interface layer 106 is disposed is the stress concentrated region in the polishing process.

In the embodiment shown in FIG. 1, the adhesion-reducing interface layer 106 is disposed in the central region C of the polishing pad 100. However, the invention is not limited thereto. In other embodiments, the adhesion-reducing interface layer may also be disposed in the peripheral region of the polishing pad. In the following, details will be described with reference to FIG. 2.

Figure 2:
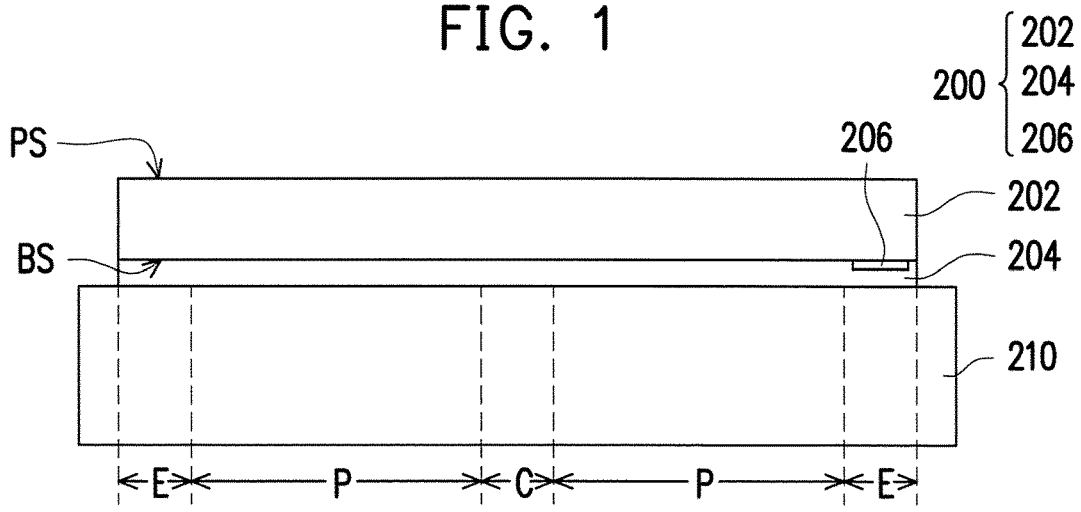
FIG. 2 is a schematic cross-sectional view illustrating a polishing pad disposed on a polishing platen according to another embodiment of the invention.

FIG. 2 is a schematic cross-sectional view illustrating a polishing pad disposed on a polishing platen according to another embodiment of the invention. Referring to FIGS. 1 and 2, a polishing pad 200 of FIG. 2 is similar to the polishing pad 100 of FIG. 1. Therefore, the same or similar components are referred to with the same or similar reference symbols, and relevant descriptions shall not be repeated in the following. In addition, a polishing platen 210, a polishing layer 202, and an adhesive layer 204 are the same as or similar to corresponding components in the embodiment of FIG. 1, so relevant descriptions shall not be repeated in the following, either. In the following, descriptions will be made about the differences.

Referring to FIG. 2, an adhesion-reducing interface layer 206 is disposed in the peripheral region E of the polishing pad 200. It should be noted that, since the polishing pad 200 includes the adhesion-reducing interface layer 206, the adhesion in the stress concentrated region which is located between the adhesive layer 204 and the polishing layer 202 is significantly reduced. Therefore, during the polishing process, the region where the adhesion-reducing interface layer 206 is located in the polishing layer 202 may be deformed or shift to a suitable extent to alleviate the concentrated stress exerted on the polishing pad 200. Hence, the stress concentrated region of the polishing pad 200 may be prevented from being significantly protruding, deformed, or damaged due to the stress exerted. As a result, the usage life of the polishing pad 200 is prolonged. In another perspective, since the adhesion-reducing interface layer 206 is disposed in the peripheral region E of the polishing pad 200, the polishing pad 200 is suitable for a polishing process whose stress concentrated region is in the peripheral region E. In other words, the adhesion-reducing interface layer 206 is disposed in the stress concentrated region of the polishing process.

Besides, in the embodiments of FIGS. 1 and 2, the adhesion-reducing interface layer 106 or 206 is disposed between the adhesive layer 104 or 204 and the polishing layer 102 or 202. However, the invention is not limited thereto. In other embodiments, the adhesion-reducing interface layer may also be disposed between the adhesive layer and the polishing platen. In the following, details will be described with reference to FIG. 3.

Figure 3:
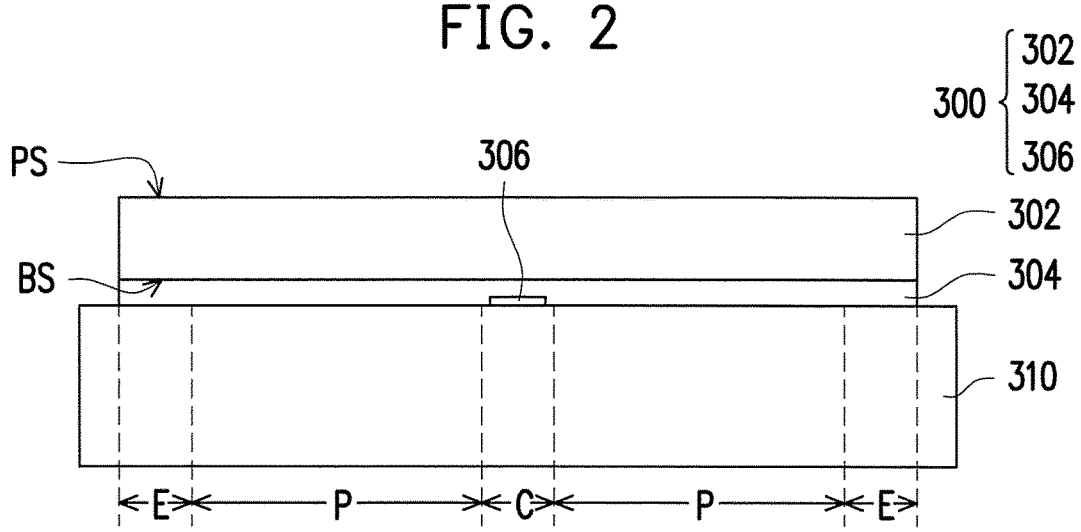
FIG. 3 is a schematic cross-sectional view illustrating a polishing pad disposed on a polishing platen according to another embodiment of the invention.

FIG. 3 is a schematic cross-sectional view illustrating a polishing pad disposed on a polishing platen according to another embodiment of the invention. Referring to FIGS. 1 and 3, a polishing pad 300 of FIG. 3 is similar to the polishing pad 100 of FIG. 1. Therefore, the same or similar components are referred to with the same or similar reference symbols, and relevant descriptions shall not be repeated in the following. In addition, a polishing platen 310, a polishing layer 302, and an adhesive layer 304 are the same as or similar to corresponding components in the embodiment of FIG. 1, so relevant descriptions shall not be repeated in the following, either. In the following, descriptions will be made about the differences.

Referring to FIG. 3, an adhesion-reducing interface layer 306 is disposed between the adhesive layer 304 and the polishing platen 310. In an embodiment, a manufacturing process of the polishing pad 300 includes: entirely forming the adhesive layer 304 on the back surface BS of the polishing layer 302 and then forming the adhesion-reducing interface layer 306, or forming the adhesion-reducing interface layer 306 on the adhesive layer 304 and then forming the adhesive layer 304 and the adhesion-reducing interface layer 306 together on the back surface BS of the polishing layer 302. In addition, the adhesive layer 304 may be formed by bonding or coating, for example. Besides, in an embodiment, the polishing pad 300 is adhered and fixed to the polishing platen 310 by bonding through the adhesive layer 304, for example. Accordingly, in the embodiment, the adhesion-reducing interface layer 306 contacts the polishing platen 310 and is covered by the adhesive layer 304.

In the embodiment, an adhesion between a portion of the adhesive layer 304 covering the adhesion-reducing interface layer 306 and the polishing platen 310 may be significantly reduced because of the adhesion-reducing interface layer 306. Specifically, compared with an adhesion between the adhesive layer 304 and the polishing platen 310 in a region without the adhesion-reducing interface layer 306, the adhesion between the adhesive layer 304 and the polishing platen 310 in the region with the adhesion-reducing interface layer 306 is reduced by 50% to 100%, and is preferably reduced by 80% to 100%.

It should be noted that, in the embodiment, since the polishing pad 300 includes the adhesion-reducing interface layer 306 disposed between the adhesive layer 304 and the polishing platen 310, and the area of the adhesion-reducing interface layer 306 is smaller than the area of the adhesive layer 304, the polishing pad 300 is able to alleviate the concentrated stress exerted on the polishing pad 300 when a polishing process is performed with the polishing pad 300. The reasons are described in detail in the following. Since the adhesion-reducing interface layer 306 is disposed between the adhesive layer 304 and the polishing platen 310, the adhesion in the stress concentrated region which is located between the adhesive layer 304 and the polishing platen 310 is significantly reduced. Therefore, during the polishing process, the region where the adhesion-reducing interface layer 306 is located in the polishing layer 302 and the adhesive layer 304 may be deformed or shift to a suitable extent to alleviate the concentrated stress exerted on the polishing pad 300. Hence, the stress concentrated region of the polishing pad 300 may be prevented from being significantly protruding, deformed, or damaged due to the stress exerted. As a result, the usage life of the polishing pad 300 is prolonged. In another perspective, since the adhesion-reducing interface layer 306 is disposed in the central region C of the polishing pad 300, the polishing pad 300 is suitable for a polishing process whose stress concentrated region is in the central region C. In other words, where the adhesion-reducing interface layer 306 is disposed is the stress concentrated region in the polishing process.

In general, the stress concentrated region of the polishing pad may be distributed differently if different polishing apparatuses are adopted for the polishing process. Specifically, there may be one stress concentrated region in the polishing pad, for example, and this one stress concentrated region locates in the central region or the peripheral region of the polishing pad. Alternatively, there may be two or more stress concentrated regions in the polishing pad, for example, and these stress concentrated regions locate in the central region and the peripheral region. In other words, during the polishing process, there may be one or more stress concentrated regions in the polishing pad. In another perspective, the position of the stress concentrated region depends on the different polishing processes or polishing apparatus, and thus the region with the adhesion-reducing interface layer may be disposed correspondingly. Hence, people having ordinary skill in the art shall appreciate that the polishing pad of the invention shall not be limited to those illustrated in FIGS. 1 to 3. Any polishing pad including at least one adhesion-reducing interface layer and disposed between the adhesive layer and the polishing layer and/or between the adhesive layer and the polishing platen falls into the scope of the invention.

Based on the above, the polishing pad of the invention includes the at least one adhesion-reducing interface layer disposed between the adhesive layer and the polishing layer and/or between the adhesive layer and the polishing platen, and the area of the at least one adhesion-reducing interface layer is smaller than the area of the adhesive layer. Thus, during the polishing process, the polishing pad of the invention is able to alleviate the concentrated stress exerted on the polishing pad, so as to prolong the usage life of polishing pad.

Figure 4:
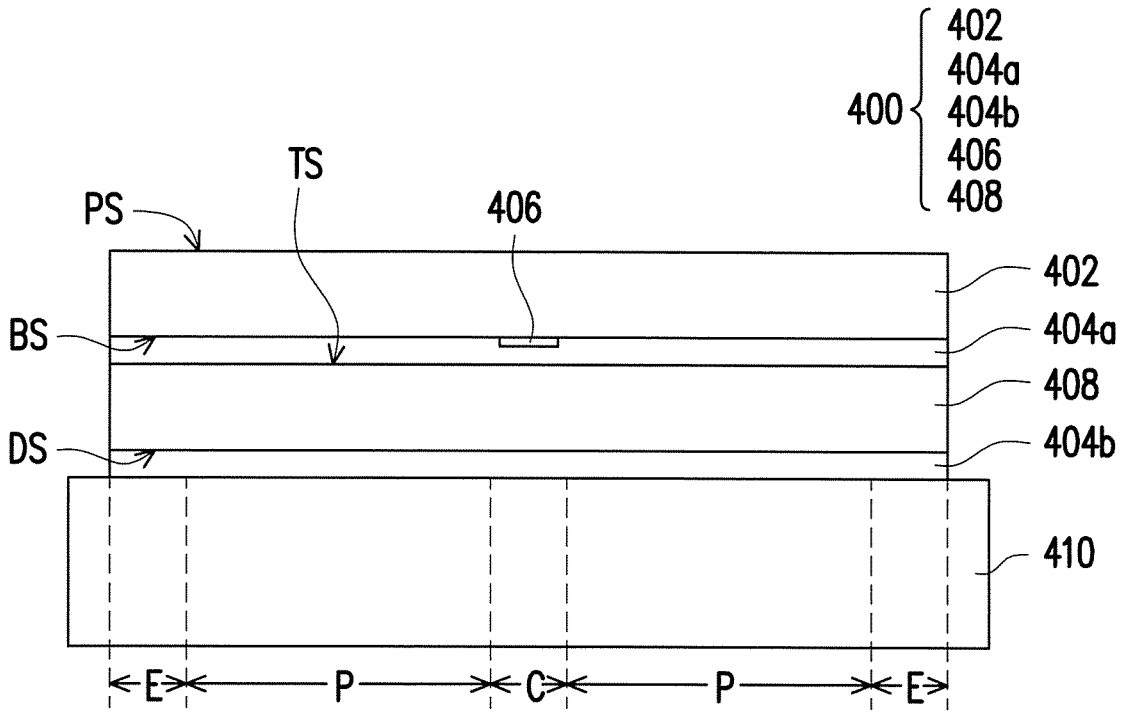
FIG. 4 is a schematic cross-sectional view illustrating a polishing pad disposed on a polishing platen according to another embodiment of the invention.

FIG. 4 is a schematic cross-sectional view illustrating a polishing pad disposed on a polishing platen according to another embodiment of the invention. Similarly, FIG. 4 is a schematic cross-sectional view taken along a radius direction of a polishing pad 400. Referring to FIGS. 4 and 1, the polishing pad 400 of FIG. 4 is similar to the polishing pad 100 of FIG. 1, except that the structures of the polishing pads 400 and 100 are different. Therefore, the same or similar components are referred to with the same or similar reference symbols, and relevant descriptions may be referred to the foregoing and shall not be repeated in the following. In addition, a polishing platen 410 and a polishing layer 402 are the same as or similar to corresponding components in the embodiment of FIG. 1, so relevant descriptions shall not be repeated in the following, either. In the following, only descriptions about the differences are made.

Referring to FIG. 4, the polishing pad 400 includes a base layer 408 disposed below the polishing layer 402. Specifically, in the embodiment, the base layer 408 is provided for underlaying the polishing layer 402 of the polishing pad 400. In addition, the material of the base layer 408 includes polyurethane, polybutadiene, polyethylene, polypropylene, a copolymer of polyethylene and ethylene vinyl acetate, or a copolymer of polypropylene and ethylene vinyl acetate, for example. However, the invention is not limited thereto. Besides, in the embodiment, the base layer 408 includes a top surface TS and a lower surface DS opposite to the top surface TS. In addition, the top surface TS and the lower surface DS are respectively flat surfaces. In other words, no recess or groove pattern is provided on the top surface TS and the bottom surface DS of the base layer 408 in the embodiment.

The polishing pad 400 also includes a first adhesive layer 404*a* which is located between the polishing layer 402 and the base layer 408. Specifically, in the embodiment, the back surface BS of the polishing layer 402 and the top surface TS of the base layer 408 are adhered through the first adhesive layer 404*a*. Besides, in the embodiment, the first adhesive layer 404*a* is a continuous glue layer including (but is not limited to) an unsupported glue layer, a double-sided glue layer, a hot melt glue layer, or a moisture curable glue layer. The material of the glue layer includes, for example, an acrylic-based glue, an epoxy resin-based glue, or a polyurethane-based glue. However, the invention is not limited thereto.

The polishing pad 400 includes a second adhesive layer 404*b* disposed between the base layer 408 and the polishing platen 410. Specifically, in the embodiment, the bottom surface DS of the base layer 408 and the polishing platen 410 are adhered through the second adhesive layer 404*b*. In other words, the polishing pad 400 is adhered and fixed to the polishing platen 410 through the second adhesive layer 404*b*. Besides, in the embodiment, the second adhesive layer 404*b* is a continuous glue layer including (but not limited to) an unsupported glue layer or a double-sided glue layer. The material of the glue layer includes, for example, an acrylic-based glue, an epoxy resin-based glue, or a polyurethane-based glue. However, the invention is not limited thereto.

The polishing pad 400 includes an adhesion-reducing interface layer 406 which is located between the first adhesive layer 404*a* and the polishing layer 402. In an embodiment, a manufacturing process of the polishing pad 400 includes the following steps. First, the adhesion-reducing interface layer 406 is formed on the back surface BS of the polishing layer 402 and then the first adhesive layer 404*a* is entirely formed, or the adhesion-reducing interface layer 406 is formed on the first adhesive layer 404*a* and then the first adhesive layer 404*a* and the adhesion-reducing interface layer 406 are formed together on the back surface BS of the polishing layer 402. In addition, the first adhesive layer 404*a* may be formed by bonding or coating, for example. Then, after the base layer 408 is adhered and fixed to the first adhesive layer 404*a* by bonding, for example, the second adhesive layer 404*b* is formed on the bottom surface DS of the base layer 408. In addition, the second adhesive layer 404*b* may be formed by bonding or coating, for example. Accordingly, in the embodiment, the adhesion-reducing interface layer 406 contacts the back surface BS of the polishing layer 402 and is covered by the first adhesive layer 404*a*.

Besides, in the embodiment, the area of the adhesion-reducing interface layer 406 is smaller than the area of the first adhesive layer 404*a* or the area of the second adhesive layer 404*b*. Specifically, the area of the adhesion-reducing interface layer 406 is in a range from 0.01% to 20% of the area of the first adhesive layer 404*a*, and is preferably 0.05% to 10% of the area of the first adhesive layer 404*a*, or the area of the adhesion-reducing interface layer 406 is in a range from 0.01% to 20% of the area of the second adhesive layer 404*b*, and is preferably 0.05% to 10% of the area of the second adhesive layer 404*b*. When the area of the adhesion-reducing interface layer 406 is smaller than 0.01% of the area of the first adhesive layer 404*a* or the second adhesive layer 404*b*, the polishing pad may be difficult to alleviate the stress. When the area of the adhesion-reducing interface layer 406 is greater than 20% of the area of the first adhesive layer 404*a* or the second adhesive layer 404*b*, the polishing pad may be detached from the polishing platen during the polishing process due to an excessively small effective adhesive area.

Besides, in the embodiment, the adhesion-reducing interface layer 406 includes (but is not limited to): (1) an anti-adhesive agent or a release agent implemented by coating, wherein the anti-adhesive agent is an organic oil or an organic solvent, for example, and the release agent is a fluorine-containing release agent or a silicone-containing release agent, for example; (2) a powder, a fiber, an isolation film, or a low adhesion glue implemented by attachment or adhesion, wherein the powder is a metal powder, a ceramic powder, or an organic powder, for example, the fiber may be a natural fiber or an artificial fiber, for example, the isolation film may be a continuous or a discontinuous film and may be a metal film, a polymer thin film, or a release film, for example, and the low adhesion glue may be a silicone-based glue or a rubber-based glue; or (3) a surface treatment layer implemented by a surface treatment process, wherein the surface treatment layer may be a surface treatment layer with a significantly reduced adhesion formed on the surface of the first adhesive layer 404*a* through a physical process or a chemical process, for example, and the process may be a high temperature process, an irradiation process, an implantation process, a gas process, a plasma process, or a chemical solution process. In other words, in the embodiment, an adhesion between the adhesion-reducing interface layer 406 and the polishing layer 402 is less than an adhesion between the first adhesive layer 404*a* and the polishing layer 402, and/or an adhesion between the first adhesive layer 404*a* and the adhesion-reducing interface layer 406 is less than the adhesion between the first adhesive layer 404*a* and the polishing layer 402. For example, when the adhesion-reducing interface layer 406 includes a powder, a fiber, an isolation film, a low adhesion glue or a surface treatment layer, the adhesion between the adhesion-reducing interface layer 406 and the polishing layer 402 is less than the adhesion between the first adhesive layer 404*a* and the polishing layer 402. In another example, when the adhesion-reducing interface layer 406 includes an anti-adhesion agent or a release agent, the adhesion between the adhesion-reducing interface layer 406 and the polishing layer 402 is less than the adhesion between the first adhesive layer 404*a* and the polishing layer 402, and the adhesion between the first adhesive layer 404*a* and the adhesion-reducing interface layer 406 is less than the adhesion between the first adhesive layer 404*a* and the polishing layer 402. Therefore, an adhesion between a portion of the first adhesive layer 404*a* covering the adhesion-reducing interface layer 406 and the polishing layer 402 may be significantly reduced because of the adhesion-reducing interface layer 406. Specifically, compared with an adhesion between the first adhesive layer 404*a* and the polishing layer 402 in a region without the adhesion-reducing interface layer 406, the adhesion between the first adhesive layer 404*a* and the polishing layer 402 in the region with the adhesion-reducing interface layer 406 is reduced by 50% to 100%, and is preferably reduced by 80% to 100%.

It should be noted that, in the embodiment, since the polishing pad 400 includes the adhesion-reducing interface layer 406 disposed between the first adhesive layer 404*a* and the polishing layer 402, and the area of the adhesion-reducing interface layer 406 is smaller than the area of the first adhesive layer 404*a*, the polishing pad 400 is able to alleviate the concentrated stress exerted on the polishing pad 400 when a polishing process is performed with the polishing pad 400. The reasons are described in detail in the following. Since the adhesion-reducing interface layer 406 is disposed between the first adhesive layer 404*a* and the polishing layer 402, the adhesion in the stress concentrated region which is located between the first adhesive layer 404*a* and the polishing layer 402 is significantly reduced. Therefore, during the polishing process, the region where the adhesion-reducing interface layer 406 is located in the polishing layer 402 may be deformed or shift to a suitable extent to alleviate the concentrated stress exerted on the polishing pad 400. Hence, the stress concentrated region of the polishing pad 400 may be prevented from being significantly protruding, deformed, or damaged due to the stress exerted. As a result, the usage life of the polishing pad 400 is prolonged. In another perspective, since the adhesion-reducing interface layer 406 is disposed in the central region C of the polishing pad 400, the polishing pad 400 is suitable for a polishing process whose stress concentrated region is in the central region C. In other words, where the adhesion-reducing interface layer 406 is disposed is the stress concentrated region in the polishing process.

Besides, in the embodiment of FIG. 4, the adhesion-reducing interface layer 406 is disposed between the first adhesive layer 404*a* and the polishing layer 402. However, the invention is not limited thereto. In other embodiments, the adhesion-reducing interface layer may also be disposed at an interface between any two adjacent layers of the first adhesive layer, the base layer, and the second adhesive layer. Alternatively, the adhesion-reducing interface layer may also be disposed between the second adhesive layer and the polishing platen. In the following, details will be described with reference to FIGS. 5 to 7.

Figure 5:
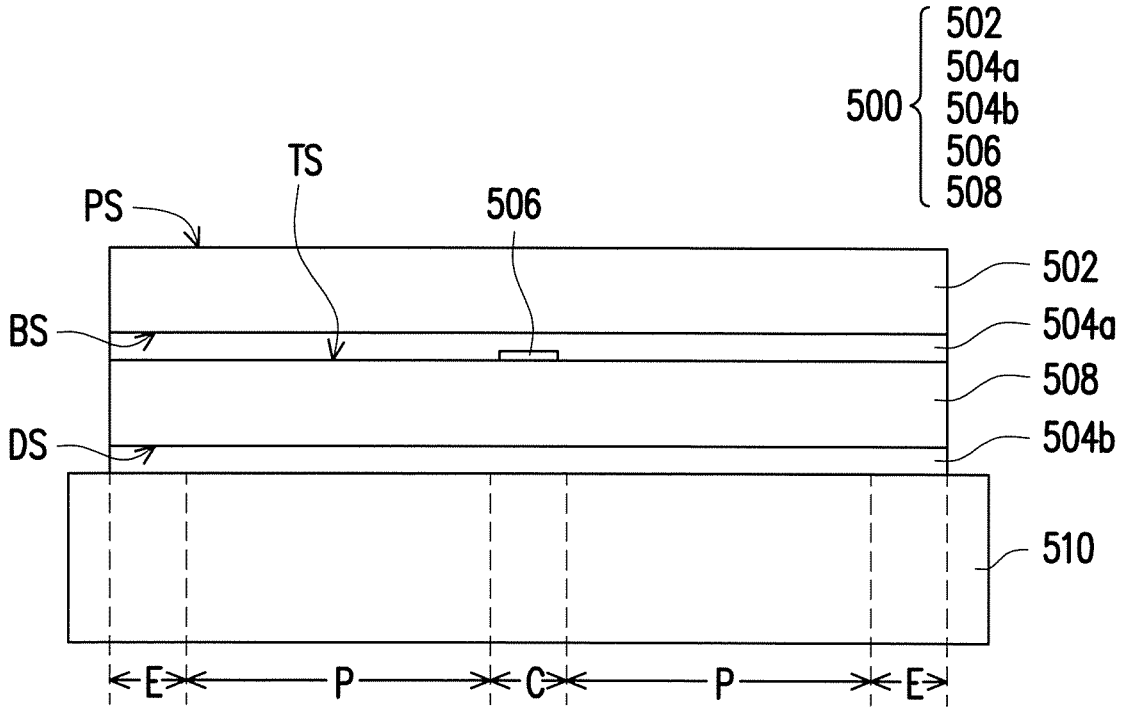
FIG. 5 is a schematic cross-sectional view illustrating a polishing pad disposed on a polishing platen according to another embodiment of the invention.

FIG. 5 is a schematic cross-sectional view illustrating a polishing pad disposed on a polishing platen according to another embodiment of the invention. Referring to FIGS. 4 and 5, a polishing pad 500 of FIG. 5 is similar to the polishing pad 400 of FIG. 4. Therefore, the same or similar components are referred to with the same or similar reference symbols, and relevant descriptions shall not be repeated in the following. Besides, a polishing platen 510, a polishing layer 502, a first adhesive layer 504*a*, a second polishing layer 504*b*, and a base layer 508 are the same as or similar to corresponding components in the embodiment of FIG. 4. Therefore, relevant descriptions shall not be repeated in the following, either. In the following, descriptions will be made about the differences.

Referring to FIG. 5, the adhesion-reducing interface layer 506 is disposed between the first adhesive layer 504*a* and the base layer 508. In an embodiment, a manufacturing process of the polishing pad 500 includes the following steps. First, the first adhesive layer 504*a* is entirely formed on the back surface BS of the polishing layer 502 and then the adhesion-reducing interface layer 506 is formed, or the adhesion-reducing interface layer 506 is formed on the first adhesive layer 504*a* and then the first adhesive layer 504*a* and the adhesion-reducing interface layer 506 are together formed on the back surface BS of the polishing layer 502. In addition, the first adhesive layer 504*a* may be formed by bonding or coating, for example. Then, after the base layer 508 is adhered and fixed to the first adhesive layer 504*a* by bonding, for example, the second adhesive layer 504*b* is formed on the bottom surface DS of the base layer 508. In addition, the second adhesive layer 504*b* may be formed by bonding or coating, for example. Accordingly, in the embodiment, the adhesion-reducing interface layer 506 contacts the base layer 508 and is covered by the first adhesive layer 504*a*.

In the embodiment, an adhesion between a portion of the first adhesive layer 504*a* covering the adhesion-reducing interface layer 506 and the base layer 508 may be significantly reduced because of the adhesion-reducing interface layer 506. Specifically, compared with an adhesion between the first adhesive layer 504*a* and the base layer 508 in a region without the adhesion-reducing interface layer 506, the adhesion between the first adhesive layer 504*a* and the base layer 508 in the region with the adhesion-reducing interface layer 506 is reduced by 50% to 100%, and is preferably reduced by 80% to 100%.

It should be noted that, in the embodiment, since the polishing pad 500 includes the adhesion-reducing interface layer 506 which is disposed between the first adhesive layer 504*a* and the base layer 508, and the area of the adhesion-reducing interface layer 506 is smaller than the area of the first adhesive layer 504*a* or the second adhesive layer 504*b*, the polishing pad 500 is able to alleviate the concentrated stress exerted on the polishing pad 500 when a polishing process is performed with the polishing pad 500. The reasons are described in detail in the following. Since the adhesion-reducing interface layer 506 is disposed between the first adhesive layer 504*a* and the base layer 508, the adhesion in the stress concentrated region which is located between the first adhesive layer 504*a* and the base layer 508 in the is significantly reduced. Therefore, during the polishing process, the region where the adhesion-reducing interface layer 506 is located in the polishing layer 502 and the first adhesive layer 504*a* may be deformed or shift to a suitable extent to alleviate the concentrated stress exerted on the polishing pad 500. Hence, the stress concentrated region of the polishing pad 500 may be prevented from being significantly protruding, deformed, or damaged due to the stress exerted. As a result, the usage life of the polishing pad 500 is prolonged. In another perspective, since the adhesion-reducing interface layer 506 is disposed in the central region C of the polishing pad 500, the polishing pad 500 is suitable for a polishing process whose stress concentrated region is in the central region C. In other words, where the adhesion-reducing interface layer 506 is disposed is the stress concentrated region in the polishing process.

Figure 6:
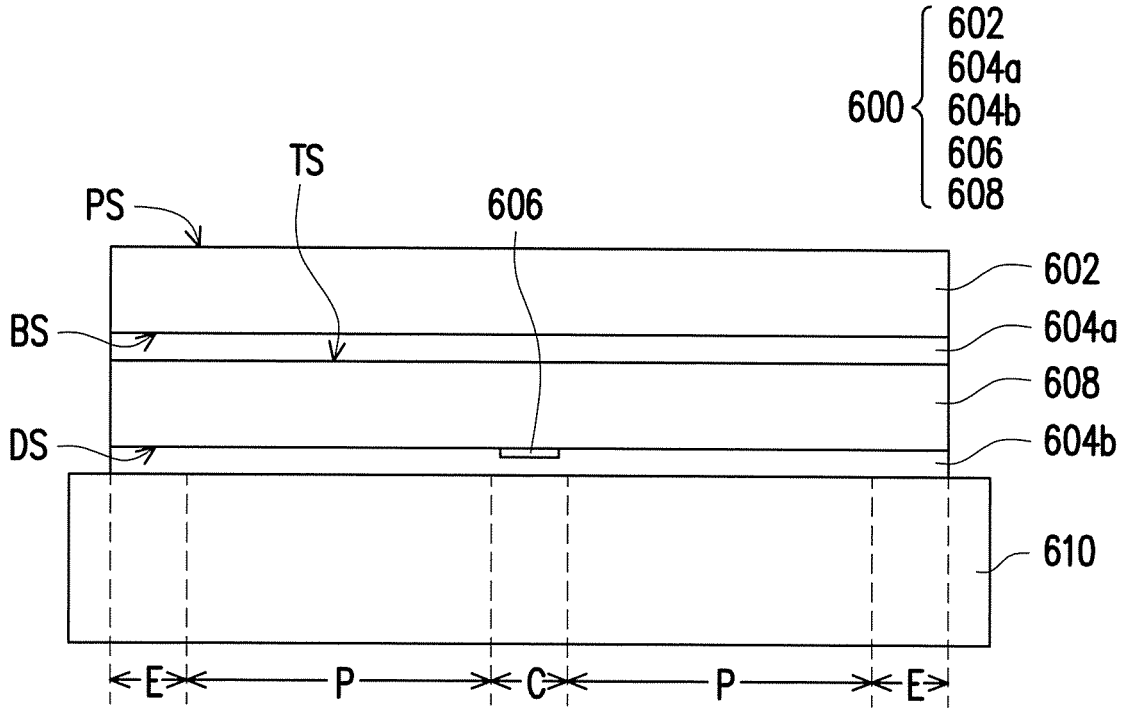
FIG. 6 is a schematic cross-sectional view illustrating a polishing pad disposed on a polishing platen according to another embodiment of the invention.

FIG. 6 is a schematic cross-sectional view illustrating a polishing pad disposed on a polishing platen according to another embodiment of the invention. Referring to FIGS. 4 and 6, a polishing pad 600 of FIG. 6 is similar to the polishing pad 400 of FIG. 4. Therefore, the same or similar components are referred to with the same or similar reference symbols, and relevant descriptions shall not be repeated in the following. Besides, a polishing platen 610, a polishing layer 602, a first adhesive layer 604*a*, a second polishing layer 604*b*, and a base layer 608 are the same as or similar to corresponding components in the embodiment of FIG. 4. Therefore, relevant descriptions shall not be repeated in the following, either. In the following, descriptions will be made about the differences.

Referring to FIG. 6, an adhesion-reducing interface layer 606 is disposed between the base layer 608 and the second adhesive layer 604*b*. In an embodiment, a manufacturing process of the polishing pad 600 includes the following steps. First, the first adhesive layer 604*a* is entirely formed on the back surface BS of the polishing layer 602 and then the base layer 608 is adhered and fixed to the first adhesive layer 604*a* by bonding, for example. In addition, the first adhesive layer 604*a* may be formed by bonding or coating, for example. Then, the adhesion-reducing interface layer 606 is formed on the bottom surface DS of the base layer 608, and then the second adhesive layer 604*b* is entirely formed. Alternatively, the adhesion-reducing interface layer 606 is formed on the second adhesive layer 604*b* and then the adhesion-reducing interface layer 606 and the second adhesive layer 604*b* are formed together on the bottom surface DS of the base layer 608. In addition, the second adhesive layer 604*b* may be formed by bonding or coating, for example. Accordingly, in the embodiment, the adhesion-reducing interface layer 606 contacts the base layer 608 and is covered by the second adhesive layer 604*b*.

In the embodiment, an adhesion between a portion of the second adhesive layer 604*b* covering the adhesion-reducing interface layer 606 and the base layer 608 may be significantly reduced because of the adhesion-reducing interface layer 606. Specifically, compared with an adhesion between the second adhesive layer 604*b* and the base layer 608 in region without the adhesion-reducing interface layer 606, the adhesion between the second adhesive layer 604*b* and the base layer 608 in the region with the adhesion-reducing interface layer 606 is reduced by 50% to 100%, and is preferably reduced by 80% to 100%.

It should be noted that, in the embodiment, since the polishing pad 600 includes the adhesion-reducing interface layer 606 which is disposed between the second adhesive layer 604*b* and the base layer 608, and the area of the adhesion-reducing interface layer 606 is smaller than the area of the first adhesive layer 604*a* or the second adhesive layer 604*b*, the polishing pad 600 is able to alleviate the concentrated stress exerted on the polishing pad 600 when a polishing process is performed with the polishing pad 600. The reasons are described in detail in the following. Since the adhesion-reducing interface layer 606 is disposed between the second adhesive layer 604*b* and the base layer 608, the adhesion in the stress concentrated region which is located between the second adhesive layer 604*b* and the base layer 608 is significantly reduced. Therefore, during the polishing process, the region where the adhesion-reducing interface layer 606 is located in the polishing layer 602, the first adhesive layer 604*a*, and the base layer 608 may be deformed or shift to a suitable extent to alleviate the concentrated stress exerted on the polishing pad 600. Hence, the stress concentrated region of the polishing pad 600 may be prevented from being significantly protruding, deformed, or damaged due to the stress exerted. As a result, the usage life of the polishing pad 600 is prolonged. In another perspective, since the adhesion-reducing interface layer 606 is disposed in the central region C of the polishing pad 600, the polishing pad 600 is suitable for a polishing process whose stress concentrated region is in the central region C. In other words, where the adhesion-reducing interface layer 606 is disposed is the stress concentrated region in the polishing process.

Figure 7:
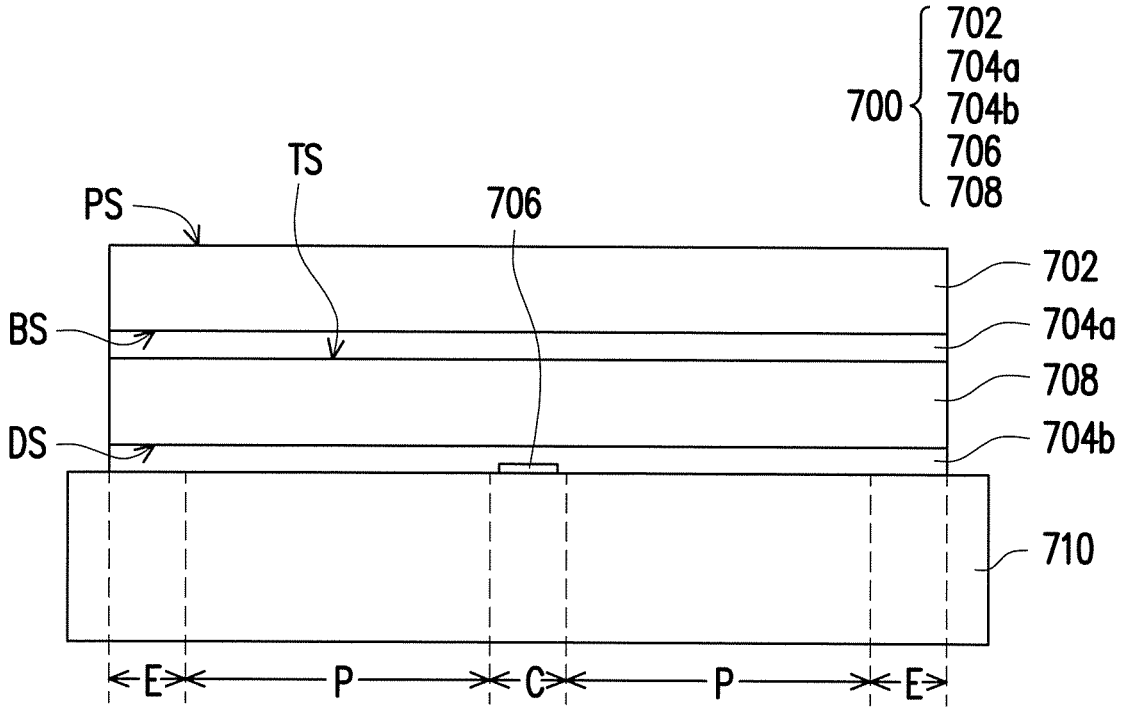
FIG. 7 is a schematic cross-sectional view illustrating a polishing pad disposed on a polishing platen according to another embodiment of the invention.

FIG. 7 is a schematic cross-sectional view illustrating a polishing pad disposed on a polishing platen according to another embodiment of the invention. Referring to FIGS. 4 and 7, a polishing pad 700 of FIG. 7 is similar to the polishing pad 400 of FIG. 4. Therefore, the same or similar components are referred to with the same or similar reference symbols, and relevant descriptions shall not be repeated in the following. Besides, a polishing platen 710, a polishing layer 702, a first adhesive layer 704*a*, a second polishing layer 704*b*, and a base layer 708 are the same as or similar to corresponding components in the embodiment of FIG. 4. Therefore, relevant descriptions shall not be repeated in the following, either. In the following, descriptions will be made about the differences.

Referring to FIG. 7, an adhesion-reducing interface layer 706 is disposed between the second adhesive layer 704*b* and the polishing platen 710. In an embodiment, a manufacturing process of the polishing pad 700 includes the following steps. First, the first adhesive layer 704*a* is entirely formed on the back surface BS of the polishing layer 702 and then the base layer 708 is adhered and fixed to the first adhesive layer 704*a* by bonding, for example. In addition, the first adhesive layer 704*a* may be formed by bonding or coating, for example. Then, the second adhesive layer 704*b* is entirely formed on the bottom surface DS of the base layer 708, and then the adhesion-reducing interface layer 706 is formed. Alternatively, the adhesion-reducing interface layer 706 is formed on the second adhesive layer 704*b* and then the adhesion-reducing interface layer 706 and the second adhesive layer 704*b* are formed together on the bottom surface DS of the base layer 708. In addition, the second adhesive layer 704*b* may be formed by bonding or coating, for example. Besides, in an embodiment, the polishing pad 700 is adhered and fixed to the polishing platen 710 by bonding through the second adhesive layer 704*b*, for example. Accordingly, in the embodiment, the adhesion-reducing interface layer 706 contacts the polishing platen 710 and is covered by the second adhesive layer 704*b*.

In the embodiment, an adhesion between a portion of the second adhesive layer 704*b* covering the adhesion-reducing interface layer 706 and the polishing platen 710 may be significantly reduced because of the adhesion-reducing interface layer 706. Specifically, compared with an adhesion between the second adhesive layer 704*b* and the polishing platen 710 in a region without the adhesion-reducing interface layer 706, the adhesion between the second adhesive layer 704*b* and the polishing platen 710 with the adhesion-reducing interface layer 706 is reduced by 50% to 100%, and is preferably reduced by 80% to 100%.

It should be noted that, in the embodiment, since the polishing pad 700 includes the adhesion-reducing interface layer 706 which is disposed between the second adhesive layer 704*b* and the polishing platen 710, and the area of the adhesion-reducing interface layer 706 is smaller than the area of the first adhesive layer 704*a* or the second adhesive layer 704*b*, the polishing pad 700 is able to alleviate the concentrated stress exerted on the polishing pad 700 when a polishing process is performed with the polishing pad 700. The reasons are described in detail in the following. Since the adhesion-reducing interface layer 706 is disposed between the second adhesive layer 704*b* and the polishing platen 710, the adhesion in the stress concentrated region which is located between the second adhesive layer 704*b* and the polishing platen 710 is significantly reduced. Therefore, during the polishing process, the region where the adhesion-reducing interface layer 706 is located in the polishing layer 702, the first adhesive layer 704*a*, the base layer 708 and the second adhesive layer 704*b* may be deformed or shift to a suitable extent to alleviate the concentrated stress exerted on the polishing pad 700. Hence, the stress concentrated region of the polishing pad 700 may be prevented from being significantly protruding, deformed, or damaged due to the stress exerted. As a result, the usage life of the polishing pad 700 is prolonged. In another perspective, since the adhesion-reducing interface layer 706 is disposed in the central region C of the polishing pad 700, the polishing pad 700 is suitable for a polishing process whose stress concentrated region is in the central region C. In other words, where the adhesion-reducing interface layer 706 is disposed is the stress concentrated region in the polishing process.

Besides, since different polishing apparatuses may be adopted for a polishing process, there may be more than one stress concentrated region in the polishing pad during the polishing process. For example, when there may be one stress concentrated region in the polishing pad during the polishing process, said stress concentrated region may be located in the central region or the peripheral region, and when there may be two or more stress concentrated regions in the polishing pad during the polishing process, said stress concentrated regions may be located in the central region and the peripheral region. In another perspective, the position of the stress concentrated region depends on the different polishing process or the polishing apparatus, and thus the region with the adhesion-reducing interface layer may be disposed correspondingly. Hence, people having ordinary skill in the art shall appreciate that the polishing pad of the invention shall not be limited to those illustrated in FIGS. 4 to 7. Any polishing pad including at least one adhesion-reducing interface layer disposed at one of the following positions: (a) between the first adhesive layer and the polishing layer, (b) between the first adhesive layer and the base layer, (c) between the base layer and the second adhesive layer, and (d) between the second adhesive layer and the polishing platen, shall fall into the scope of the invention.

Based on the above, the polishing pad of the invention includes the at least one adhesion-reducing interface layer disposed at least one of between the first adhesive layer and the polishing layer, between the first adhesive layer and the base layer, between the base layer and the second adhesive layer, and between the second adhesive layer and the polishing platen, and the area of the at least one adhesion-reducing interface layer is smaller than the area of the first adhesive layer or the second adhesive layer. Thus, during the polishing process, the polishing pad of the invention is able to alleviate the concentrated stress exerted on the polishing pad, so as to prolong the usage life of polishing pad.

It should be noted that, in each embodiment mentioned above, a thickness of the adhesion-reducing interface layer (e.g., 1 to 100 micrometers) may be set to be thinner than a thickness of the respective adhesive layers (e.g., 150 to 400 micrometers). Besides, the adhesive layer has an ability of deformation and fluidity when being adhered. Therefore, the adhesive layer may cover the adhesion-reducing interface layer, so that the adhesive layer and the adhesion-reducing interface layer are coplanar, or there may only be a tiny step difference between surfaces of the adhesive layer and the adhesion-reducing interface layer. Particularly, when the adhesion-reducing interface layer is implemented as a surface treatment layer foamed on the surface of the adhesive layer through a surface treatment, the adhesion-reducing interface layer and the adhesive layer are integrated and substantially coplanar. Hence, when the polishing pad of the invention is being manufactured, bubbles may be prevented from being generated at respective interfaces during adhesion, so as to prevent the bubbles from affecting the polishing pad. Besides, since the adhesion-reducing interface layer is only disposed at the interface between the adhesive layer and another layer, the adhesive layer covering the top or the bottom of the adhesion-reducing interface layer still keeps its properties. Thus, in general, the region of the polishing pad with the adhesion-reducing interface layer and the region of the polishing pad without the adhesion-reducing interface layer have similar properties, such as similar hardness, compressibility, or modulus. Consequently, the polishing pad may have more uniform polishing properties.

Figure 8:
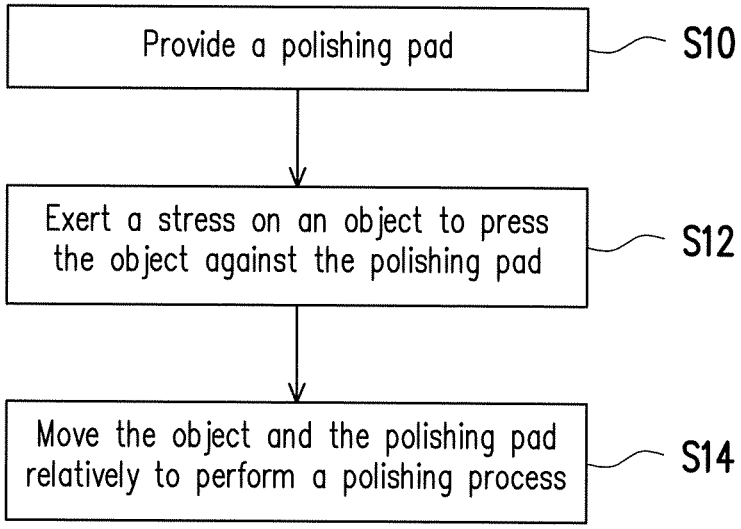
FIG. 8 is a flow chart illustrating a polishing method according to an embodiment of the invention.

FIG. 8 is a flow chart illustrating a polishing method according to an embodiment of the invention. The polishing method is suitable for polishing an object. Specifically, the polishing method according to embodiments of the invention may be applied to polishing processes for manufacturing industrial devices. For example, it may be applied to devices in the electronic industry, such as devices of semiconductors, integrated circuits, micro electro-mechanics, energy conversion, communication, optics, storage disks and displays. The objects used for manufacturing the devices may include semiconductor wafers, Group III-V wafers, storage device carriers, ceramic substrates, polymer substrates and glass substrates, but the invention is not limited thereto.

Referring to FIG. 8, first of all, a polishing pad is provided at Step S10. Specifically, in the embodiment, the polishing pad may be any of the polishing pad described in the foregoing, such as the polishing pad 100, 200, 300, 400, 500, 600, or 700. Detailed descriptions about the polishing pads 100, 200, 300, 400, 500, 600, and 700 have been made in the foregoing. Thus, details in this regard will not be repeated in the following.

Then, at Step S12, a stress is exerted on the object. Hence, the object is pressed against the polishing pad and contacts the polishing pad. Specifically, the object may contact the polishing surface PS of the polishing layer 102, 202, 302, 402, 502, 602, or 702. In addition, the stress is exerted onto the object by using a carrier capable of holding the object, for example.

Then, at Step S14, the object and the polishing pad are moved relatively to perform a polishing process on the object by using the polishing pad, thereby polishing the object. Specifically, the polishing platen 110, 210, 310, 410, 510, 610, or 710 may drive the polishing pad disposed on the polishing platen 110, 210, 310, 410, 510, 610, or 710 to rotate together, so as to generate relative movement between the polishing pad and the object.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A polishing pad, disposed on a polishing platen and configured for a polishing process, the polishing pad comprising:

a polishing layer;

an adhesive layer, disposed between the polishing layer and the polishing platen; and at least one adhesion-reducing interface layer, wherein an area of the at least one adhesion-reducing interface layer is smaller than an area of the adhesive layer, the at least one adhesion-reducing interface layer is disposed at at least one of positions comprising a position between the adhesive layer and the polishing layer and a position between the adhesive layer and the polishing platen, and the at least one adhesion-reducing interface layer comprises at least one layer of material that reduces adhesion, wherein in a region where the at least one adhesion-reducing interface layer is disposed, an adhesion of the adhesive layer is reduced by 50% to 100%.

2. The polishing pad as claimed in claim 1, wherein a region where the at least one adhesion-reducing interface layer is disposed is a stress concentrated region of the polishing process.

3. The polishing pad as claimed in claim 1, wherein a region where the at least one adhesion-reducing interface layer is disposed is a central region or a peripheral region of the polishing pad.

4. The polishing pad as claimed in claim 1, wherein the area of the at least one adhesion-reducing interface layer is in a range from 0.01% to 20% of the area of the adhesive layer.

5. The polishing pad as claimed in claim 1, wherein the at least one layer of material comprises an anti-adhesion agent, a release agent, a powder, a fiber, an isolation film, a low adhesion glue, or a surface treatment layer.

6. The polishing pad as claimed in claim 1, wherein the polishing layer has a polishing surface and a back surface opposite to the polishing surface, and the back surface is a flat surface.

7. The polishing pad as claimed in claim 1, wherein the adhesive layer is a continuous glue layer.

8. The polishing pad as claimed in claim 1, wherein the adhesive layer comprises an unsupported glue layer or a double-sided glue layer.

9. The polishing pad as claimed in claim 1, wherein a thickness of the at least one adhesion-reducing interface layer is less than a thickness of the adhesive layer.

10. A polishing method configured for polishing an object, the polishing method comprising: providing the polishing pad as claimed in claim 1; exerting a stress on the object to press the object against the polishing pad; and moving the object and the polishing pad relatively to perform the polishing process.

11. A polishing pad, disposed on a polishing platen and configured for a polishing process, the polishing pad comprising: a polishing layer; a base layer, disposed below the polishing layer; a first adhesive layer, disposed between the polishing layer and the base layer; a second adhesive layer, disposed between the base layer and the polishing platen; and at least one adhesion-reducing interface layer, wherein the at least one adhesion-reducing interface layer comprises at least one layer of material that reduces adhesion, an area of the at least one adhesion-reducing interface layer is smaller than an area of the first adhesive layer or an area of the second adhesive layer, and the at least one adhesion-reducing interface layer is disposed at at least one of the following positions: (a) between the first adhesive layer and the polishing layer; (b) between the first adhesive layer and the base layer; (c) between the base layer and the second adhesive layer; and (d) between the second adhesive layer and the polishing platen; and wherein in a region where the at least one adhesion-reducing interface layer is disposed, an adhesion of the first adhesive layer or the second adhesive layer is reduced by 50% to 100%.

12. The polishing pad as claimed in claim 11, wherein a region where the at least one adhesion-reducing interface layer is disposed is a stress concentrated region of the polishing process.

13. The polishing pad as claimed in claim 11, wherein a region where the at least one adhesion-reducing interface layer is disposed is a central region or a peripheral region of the polishing pad.

14. The polishing pad as claimed in claim 11, wherein the area of the at least one adhesion-reducing interface layer is in a range from 0.01% to 20% of the area of the first adhesive layer or the second adhesive layer.

15. The polishing pad as claimed in claim 11, wherein the at least one layer of material comprises an anti-adhesion agent, a release agent, a powder, a fiber, an isolation film, a low adhesion glue, or a surface treatment layer.

16. The polishing pad as claimed in claim 11, wherein the polishing layer has a polishing surface and a back surface opposite to the polishing surface, and the back surface is a flat surface.

17. The polishing pad as claimed in claim 11, wherein the base layer has an upper surface and a lower surface opposite to the upper surface, and the upper surface and the lower surface are respectively flat surfaces.

18. The polishing pad as claimed in claim 11, wherein the first adhesive layer is a continuous glue layer, and the first adhesive layer comprises an unsupported glue layer, a double-sided glue layer, a hot melt glue layer, or a moisture curable glue layer.

19. The polishing pad as claimed in claim 11, wherein the second adhesive layer is a continuous glue layer, and the second adhesive layer comprises an unsupported glue layer or a double-sided glue layer.

20. The polishing pad as claimed in claim 11, wherein a thickness of the at least one adhesion-reducing interface layer is less than a thickness of the first adhesive layer or the second adhesive layer.

21. A polishing method configured for polishing an object, the polishing method comprising: providing the polishing pad as claimed in claim 11; exerting a stress on the object to press the object against the polishing pad; and moving the object and the polishing pad relatively to perform the polishing process.

* * * * *